United States Patent [19]

Bjor

[11] Patent Number: 4,506,745

[45] Date of Patent: Mar. 26, 1985

[54] METHOD AND MEANS FOR DRILLING IN ROCKS

[75] Inventor: Hakon E. Bjor, Hvalstad, Norway

[73] Assignee: Bever Control A/S, Heggedal, Norway

[21] Appl. No.: 608,533

[22] Filed: May 9, 1984

Related U.S. Application Data

[63] Continuation of Ser. No. 435,880, Oct. 21, 1982, abandoned.

[30] Foreign Application Priority Data

Oct. 22, 1981 [NO] Norway ..... 813562

[51] Int. Cl.[3] ..... E21B 47/02

[52] U.S. Cl. ..... 175/45; 299/1; 175/61; 175/24

[58] Field of Search ..... 175/45, 24, 61; 299/1

[56] References Cited

U.S. PATENT DOCUMENTS

| | | | |
|---|---|---|---|
| 3,554,301 | 1/1971 | Adkins | 175/24 |
| 3,857,449 | 12/1974 | Kimura | 175/45 X |
| 4,023,861 | 5/1977 | Schnell | 299/1 |
| 4,027,210 | 5/1977 | Weber | 299/1 X |

FOREIGN PATENT DOCUMENTS 2920126 5/1979 Fed. Rep. of Germany .

*Primary Examiner*—James A. Leppink
*Assistant Examiner*—Thut M. Bui
*Attorney, Agent, or Firm*—Wenderoth, Lind & Ponack

[57] ABSTRACT

A method of drilling long and straight holes in rocks is based on the use of a drill rig which may be aligned by means of a laser beam and which comprises a hollow drill stem with a pressure device for guiding the drill stem in a correct direction on applying pressure against the wall of the drilled hole. The laser beam is sent into the hollow drill stem towards an optical detecting unit placed inside a hollow control arrangement joined into the drill stem behind its drill bit, the control arrangement being operated by means of signals from the detecting unit. The arrangement constituted a connecting piece of the drill stem and comprises a pressure device which is in contact with the wall of the hole. The optical detecting unit is arranged with free sight to the source of the laser beam as long as the drill stem is sufficiently straight.

9 Claims, 7 Drawing Figures

METHOD AND MEANS FOR DRILLING IN ROCKS

This application is a continuation of now abandoned application Ser. No. 435,880, filed Oct. 21, 1982.

BACKGROUND OF THE INVENTION

The present invention relates to a method and apparatus for drilling long and straight holes in rocks by means of a drill rig that may be aligned by means of a laser beam, which drill rig comprises a hollow drill stem with a pressure device for guiding the drill stem in a correct direction on applying pressure against the wall of the drilled hole.

Cutting of rocks and ore in mines, both above and benath ground, mainly is performed by drilling and blasting.

Investigations have shown that the costs of cutting can be reduced substantially if the technology concerning the drilling of long holes at a high precision can be mastered. In present day hole drilling operations the lengths of the holes are limited by large hole deviations, which means that it hardly can be foreseen where a hole will end.

Thus, a requirement for using longer drill holes and also for increasing the distance between holes is that a new drilling technology must be made available, thus making it possible to drill holes with a substantially higher precision than is obtainable today.

At present, drilling precision is limited by the stability and accuracy of the drill rigs being used, and how accurately the rigs can be adjusted in relation to a reference coordinate system.

The present development in this respect is directed to developing drill rigs with better rigidity and stability so that the drill stem can be started in the direction which is as correct as possible. Such drill rigs may improve the drilling accuracy to some extent, but fundamental limitations exist with respect to this technology.

Firstly, an uncertainty will remain with respect to the start direction of the drill. Besides, the drill stem may change direction on its way due to different reasons, such as:

inhomogeneities, slips etcetera in the rock
distortions in the drill stem
influence of gravity, etcetera.

Increasing of rigidity and stability requires more costly drill rigs. Additionally, accuracy depends on wearing of the equipment, and on the operator as well.

SUMMARY OF THE INVENTION

The object of the present invention is provide a method and apparatus for drilling holes with complete accuracy independent of the length of the hole, and without necessitating improvement of the rigidity of the drill rig.

The method according to the invention includes sending a laser beam through the hollow drill stem towards an optical detecting unit placed inside a hollow control means that constitutes a portion of the drill stem, which control means comprises a pressure device, and deriving laser generated signals from the detecting unit for control of the pressure device, whereby long and straight holes can be drilled with high accuracy. In this way deviations can be reduced to essentially less than the diameter of the drill hole.

The laser beam is led through a window at the rear of the drilling assembly and then passes through the interior of the hollow drill stem which is filled with filtered air. Since the drill stem is guided automatically at all times, the hole will be so straight that the laser beam can pass unhindered through the entire length of the drill stem as the drilling operation is being carried out.

The apparatus according to the invention includes a connecting piece joined into the hollow drill stem behind its drill bit and a pressure device and an optical detecting unit having free sight to the source of the laser beam as long as the drill stem remains sufficiently straight. Thus, the end of the drill stem is aligned along the extension of the laser beam.

This apparatus can be an autonomic and automatic unit which can be joined into the drill stem without additional physical connections out from the drill hole.

The apparatus controls the drilling direction either by introducing a bend on the drill stem or by pushing the drill stem in a correct direction sideways in relation to the wall of the hole.

Energy for this control can be obtained in various ways. In the most simple way energy can be obtained by utilizing compressed air being supplied through the hollow drill stem, or by utilizing energy from the rotation of the drill stem in relation to the wall of the drill hole.

The apparatus includes a photo detector to detect relative position and direction of the drill in relation to the laser beam. The detector can be designed to measure both sign and magnitude of the deviation or alternatively only its sign, so that a control unit built into the apparatus can determine in which direction the course is to be corrected.

The photo detector must determine the position of the laser beam without regard to where the beam hits within the cross section of the hollow drill stem. On the other hand, the photo detector must not hinder the passage of compressed air forward to the drill bit and a possbile hammer. In one way this can be achieved by shaping the photo detector as a narrow arm across the tubular connecting piece, such that the compressed air can pass on both sides of the detector, and let the laser beam sweep across the entire cross section as the drill stem rotates.

BRIEF DESCRIPTION OF THE DRAWINGS

In order to further explain the invention an example of the method and means will be described below with reference to the accompanying drawings, wherein.

DETAILED DESCRIPTION OF THE INVENTION

Figure 1:
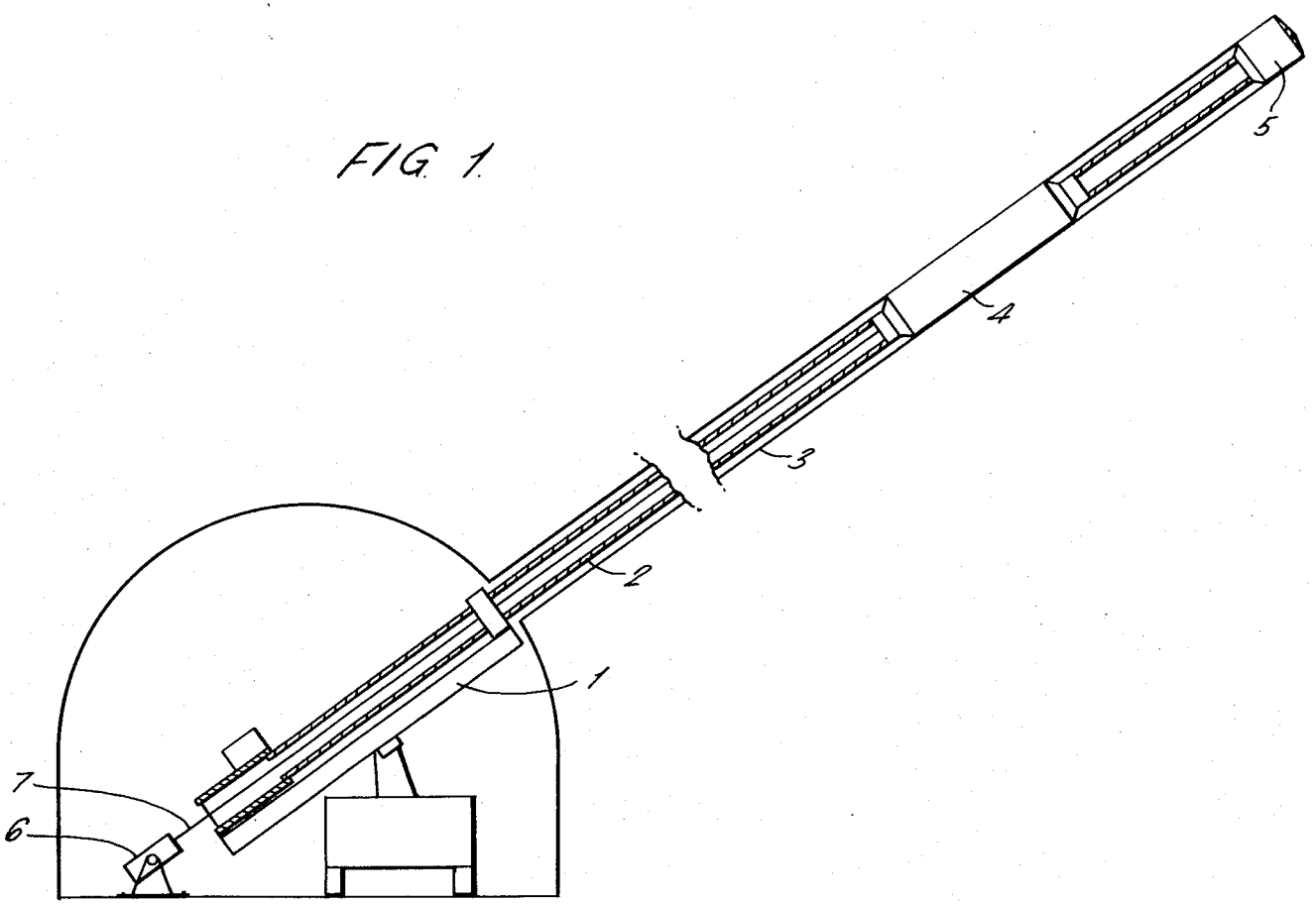
FIG. 1 is a schematic view showing setting up of equipment for performance of the method of the invention.

In FIG. 1 a drill rig 1 pushes and rotates a hollow drill stem 2 in a drill hole 3. The drill stem 2 comprises a drill bit 5, possibly with an air operated drilling hammer. Behind these components is joined into the drill stem 2 a means 4 that automatically bends the drill stem such that the drill bit 5 follows the direction of a laser beam 7 from a source 6 which is mounted steadily and apart from the drill rig 1, so that the laser beam is conducted inside the hollow drill stem 2.

Figure 2:
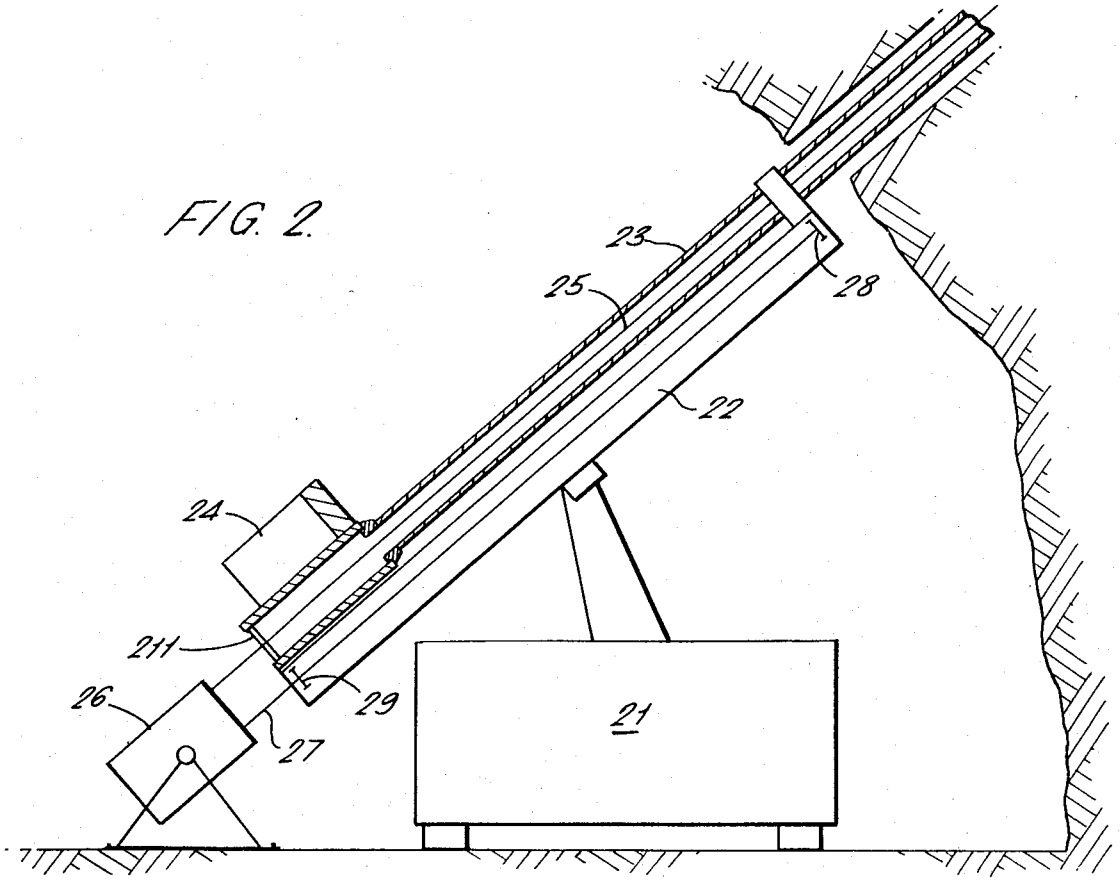
FIG. 2 is a similar view, but showing further details of a drill rig for performance of the method.

In FIG. 2 the drill rig 21 carries a feed support 22 for a drill stem 23 and a rotary motor 24. A laser beam 25 from a source 26 is conducted into the hollow drill stem 23 through a window 211 which encloses compressed air in the drill stem. The source 26 can send out one or more laser beams 27 parallel to the main beam 25. The purpose of these beams is to simplify the adjustment of the feed support 22, this support being equipped with sighting aids 28 and 29 to control in a simple manner that the feed support is in a correct position, within tolerance, at start of drilling.

Figure 3:
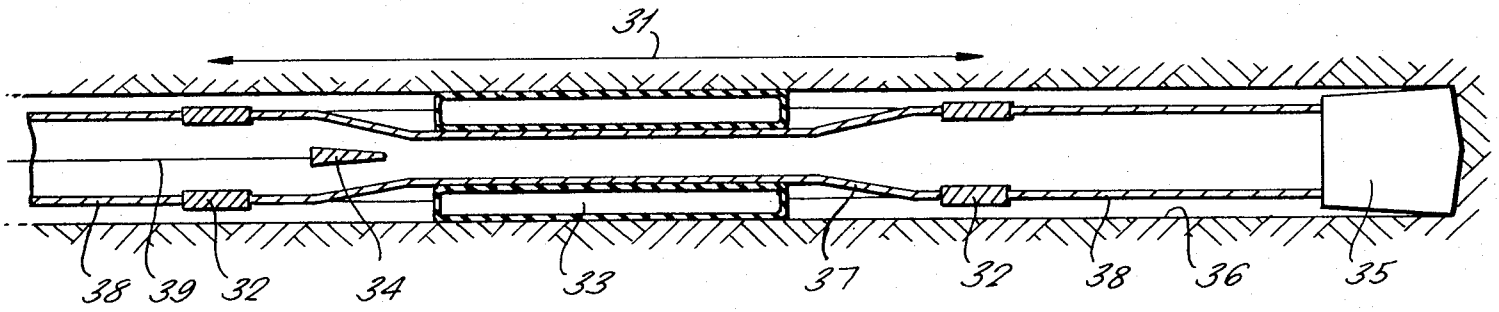
FIG. 3 is a longitudinal section of means for automatic control of the drill stem.

In FIG. 3 a hollow control means 31 comprises a tube 37 having been joined into a drill stem 38 for instance by means of usual threaded joints 32. The tube 37 rotates with the drill stem 38 when the stem 38 is rotating. Inside the tube 37 is arranged an optical sensor 34 for sensing the position and direction of the tube 37 in relation to a laser beam 39. The sensor 34 is arranged such that compressed air can pass substantially unhindered forwardly to the drill bit 35 and a possible drilling hammer. Outside the tube 37 is a sleeve 33 that is prevented from rotating with the tube 37 because of friction against the wall in the drill hole 36. The tube 37 is arranged to rotate freely in relation to the sleeve 33 for instance by means of rollers or sleeve slidings. The sleeve 33 has actuators (see FIG. 4) that can push the tube sideways inside the drill hole, such that the drill bit 35 thereby changes direction. The actuators are controlled by a control unit (shown in FIG. 3) in such a way that the drill bit 35 follows the direction of the laser beam 39 as accurately as possible at all times. The control unit may be mounted either in the sleeve on the outside of the tube 37, or inside the tube 37.

Figure 4:
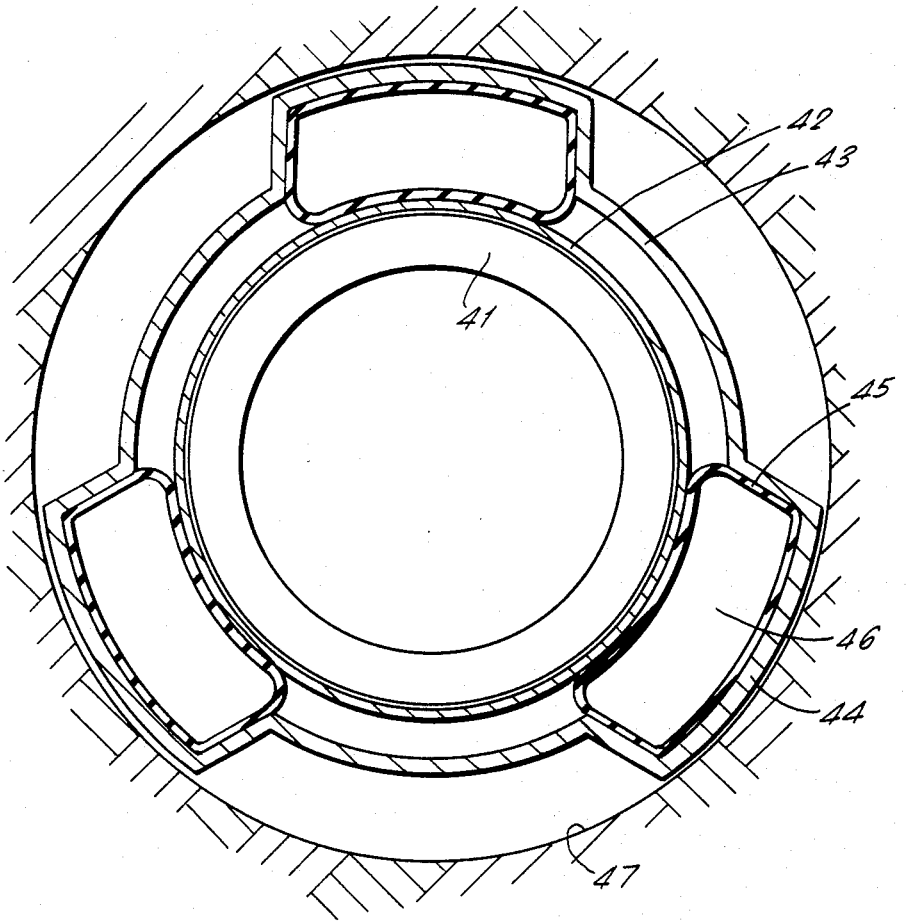
FIG. 4 is a cross section of the means for controlling the drill stem.

In FIG. 4 a tubular control means 41 rotates with a drill stem while the sleeve shown in FIG. 3 is prevented from rotating by friction against the wall of the drill hole 47. The sleeve comprises an inner bearing surface 42, an outer sliding surface 43 with wearing/friction surfaces 44 and actuators 46 with rubber bellows 45. A control unit (not shown) in FIG. 4 controls by means of valves (not shown) the supply of compressed air to the individual actuator-bellows 45 in such a way that the position of the tubular means 41 in relation to a drill hole 47 is changed intentionally.

Figure 5:
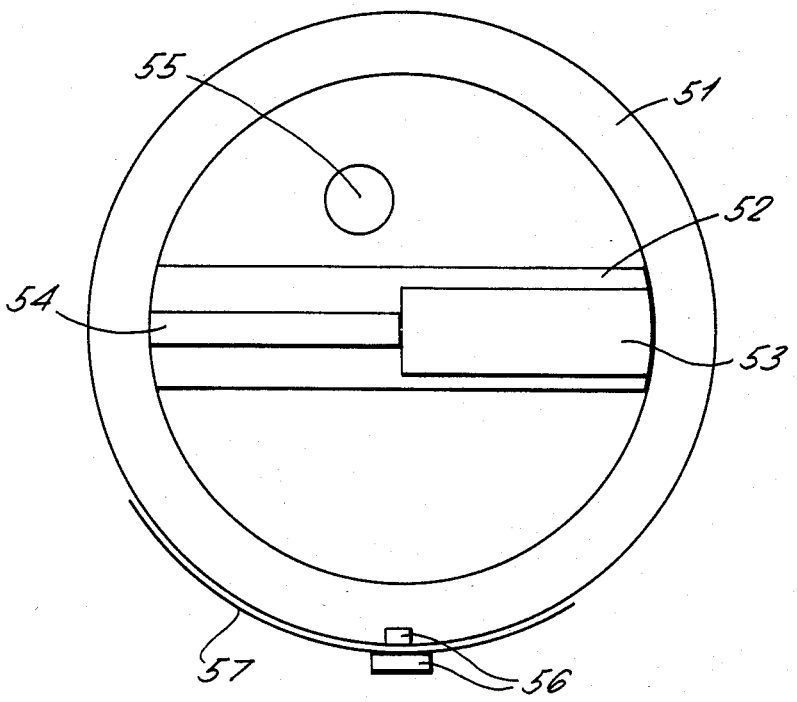
FIG. 5 is a schematic transverse view of the control means.

In FIG. 5 is shown schematically an optical sensor for sensing the position and direction of a tubular control means 51 in relation to a laser beam 55. A sensor unit 52 shaped as a narrow object is mounted diametrically in the control means 51, such that compressed air to the drill bit and a possible drilling hammer can pass through the sensor unit substantially unhindered. The dimension of the sensor unit 52 in the longitudinal direction of the control means 51 is less important.

The sensor unit 52 may comprise a member 53 for sensing the direction of the laser beam 55 in relation to the longitudinal axis of the control means 51, and a component 54 for sensing the position of the beam 55 in relation to the cross section of the control means 51. Since the control means 51 rotates about its axis, both sensors 53 and 54 will be hit by the laser beam 55 at each revolution, such that suitable laser generated signals can be derived from the sensors 53 and 54 and transferred to a control unit (not shown in FIG. 5) notwithstanding where beam 55 hits within the cross section of the tubular control means 51. The signals from the sensor unit 52 give the relative position and direction between the sensor unit 52 and the laser beam 55.

An angle sensor 56 measures the angle of rotation between the sensor unit 52 in the control means 51 and a reference direction in a guide sleeve 57. This measurement gives the necessary information to the control unit such that the control unit can correct the course of the drill stem on operating the proper actuators.

Figure 6:
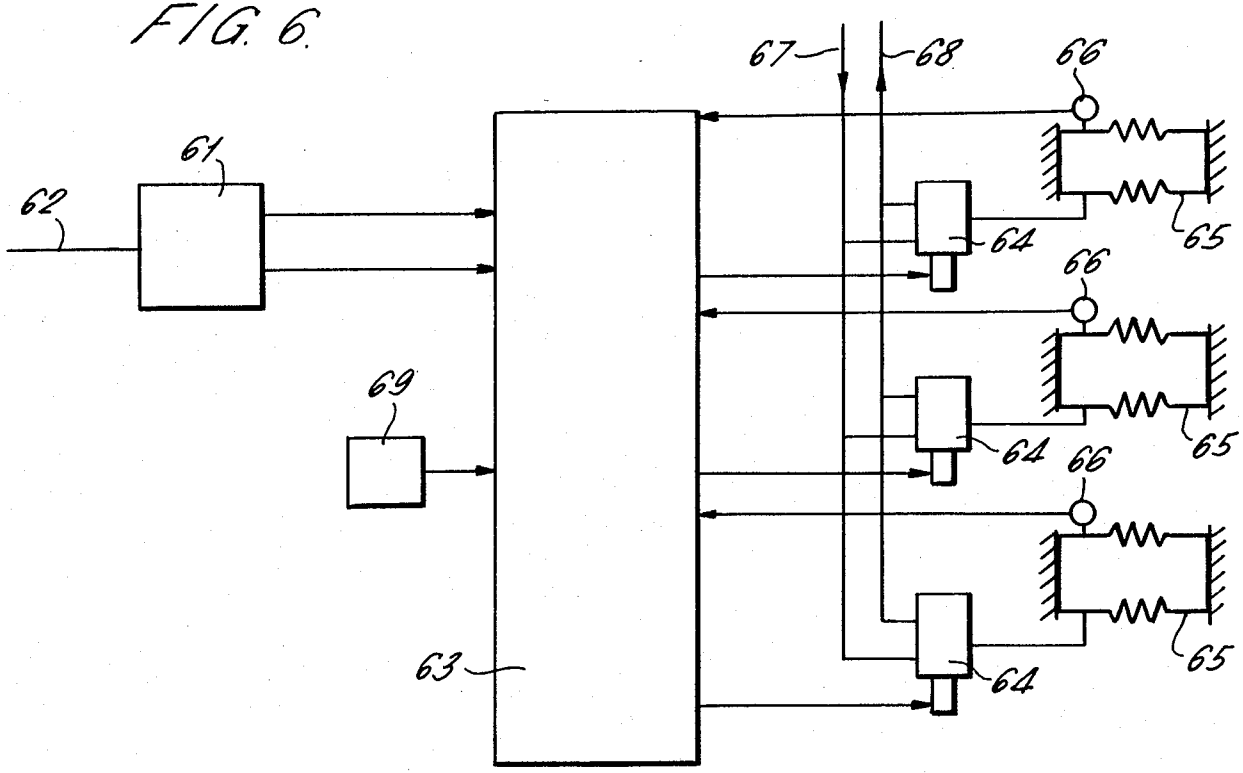
FIG. 6 is a block diagram of a preferred embodiment of a system included in the means.

FIG. 6 shows a control unit 63 which receives information on the position and direction of a sensor 61 in relation to a laser beam 62 as well as information from an angle sensor 69 on the angle of rotation of the sensor 61 in relation to such a guide sleeve 57 as has been mentioned above.

The control unit 63 processes such information and controls the air supply to actuators 65 by means of valves 64 that either admit compressed air 67 to the actuators 65 from the tubular control means described above or allow air 68 to escape from the actuators 65 to the outside of the control means where the air pressure is low.

The control system may comprise sensors 66 for sensing the position of the actuators 65 and for reporting on this information to the control unit 63. These sensors 66 are not strictly necessary, but will improve the accuracy and stability of the system.

Figure 7:
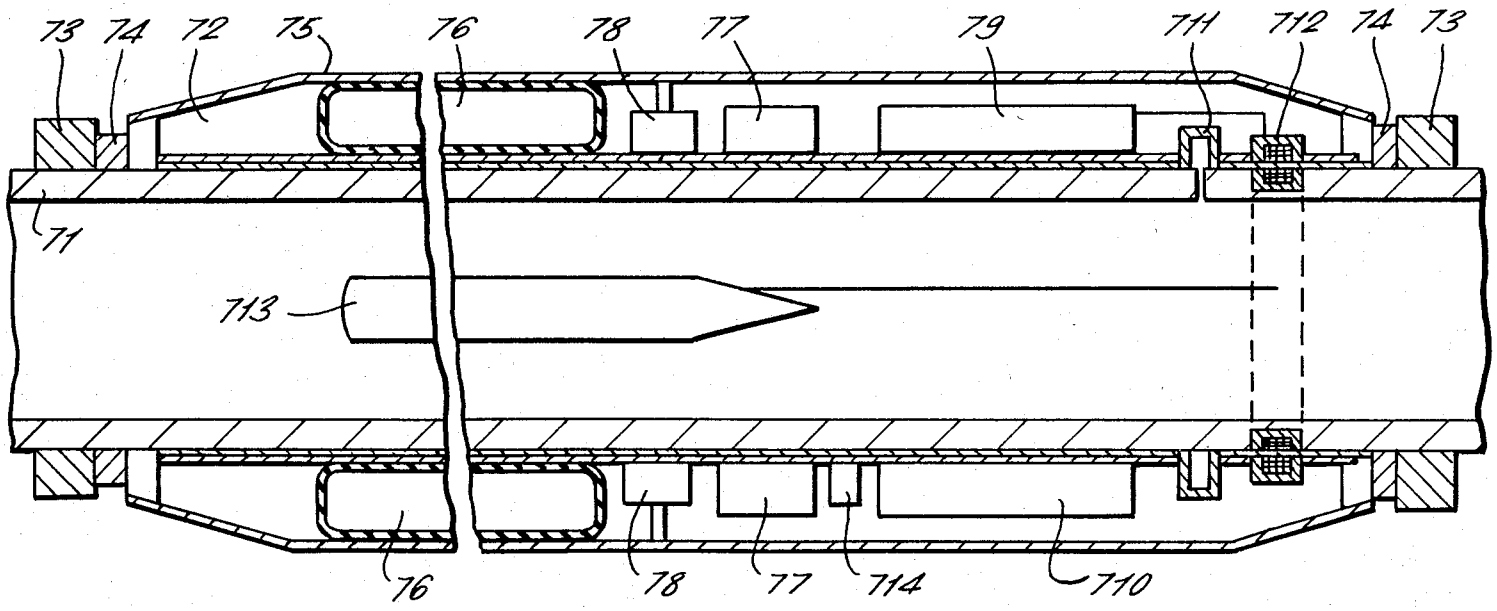
FIG. 7 is a longitudinal section of the means with a possible arrangment of components.

FIG. 7 shows a hollow control means or guide tube 71 which is joined into the drill stem. The guide tube 71 is surrounded by a guide sleeve 72. The sleeve 72 is prevented from sliding axially along the tube by clamping rings 73 which are fixed to the tube 71, and bearing rings 74 which also can act as dust tighteners, and as vibration dampers when axial vibrations in the drill stem are transferred to the sleeve 72. The outer sliding surface 75 of the sleeve 72 allows radial movements of the inner tube 71 in relation to the sliding surface 75.

Actuator bellows 76, control valves 77, sensors 78 for sensing actuator positions and a control unit 79 with batteries 710 are arranged inside the sleeve 72.

Compressed air to the actuators 76 is supplied from the guide tube 71 through a hole in the tube wall to a tight-sitting assembling ring 711.

Measured signals from an optical sensor unit 713 may be transferred to the control unit 79 via a rotating transformer coupling 712. Energy to the optical sensor unit 713 can either be supplied by a battery on the tube 71 or be transferred from a battery on the sleeve 72 via for instance a rotating transformer.

The batteries 710 may be exchangeable, provided that their capacity is sufficiently high for drilling one or more drill holes, or a charging unit may be conected thereto, which unit may be driven for instance by the compressed air.

The angle of rotation of the guide tube 71 in relation to the guide sleeve 72 is measured by means of an angle sensor 714. Since the tube 71 in practice rotates with an approximately constant speed, the angle sensor 714 can be realized by means of for example a pulse supplier that yields a pulse to the control unit 79 each time a particular spot on the circumference of the tube 71 passes the pulse supplier.

The above described performance is an example of a preferred embodiment of the invention. It will appear that the individual components can be shaped and arranged in different ways. As an example, the actuators can be designed as purely mechanically, electrically or hydraulically operated actuators, or designed to be operated in such manners in combination.

The actuators can be supplied with energy from the compressed air as described above, or from the rotating drill stem tube which rotates in relation to the sleeve. If a percussion drilling machine is used, energy may also be taken from its vibrations.

The described sliding surfaces of the sleeve can be mere sliding/friction surfaces, for instance as described. They may, however, be shaped in different ways, for instance in the form of rollers that can roll alongside the drill hole but not across it.

It is not a requirement that the guide sleeve does not rotate in relation to the wall of the drill hole, provided that rotation of the guide sleeve is so slow that the control system manages to adjust the actuators in accordance with the rotation. The energy consumption of the actuators will be less the slower the sleeve rotates.

Neither need the actuators push the rod in relation to the wall of the drill hole. Instead, the actuators may be shaped to control an angle articulation in the rod.

Preferably the control means is realized by means of new technology such as micro processors, electro-optical arrays, etcetera. However, such technology is not a requirement for realization of the means according to the invention.

The method and apparatus of the invention also can be used if the drilling hammer is driven by hydraulic or electrical energy instead of compressed air.

I claim:

1. A method for drilling straight holes of long length in solid rock by the use of a drill rig including a hollow longitudinal rotating drill stem having at the end thereof a drill bit, said method comprising:

providing as an integral portion of said drill stem a hollow control means having pressure means for moving said hollow control means relative to the wall of a hole drilled by said drill stem, with said hollow control means being located rearwardly of said drill bit a distance sufficient to cause said drill stem to bend upon operation of said pressure means to move said hollow control means relative to said wall of said hole, and thus for controlling the direction of said drill bit and the direction of said hole formed thereby;

directing a laser beam longitudinally through said drill stem and into and through said hollow control means;

detecting the relative position of said laser beam with respect to the bend of said drill stem by means of an optical detecting unit positioned within said hollow control means, and generating signals representative thereof within said hollow control means; and processing said signals within said hollow control means and operating said pressure means to move said hollow control means relative to said wall of said hole and thereby to bend said drill stem while said drill bit remains in a locked position in said rock, thereby controlling the direction of drilling by said drill stem.

2. An apparatus for drilling straight holes of long length in solid rock, said apparatus comprising:

a drill rig including a hollow longitudinal rotating drill stem having at an end thereof a drill bit;

hollow control means, integral with said drill stem, for controlling the direction of said drill bit and the direction of a hole formed thereby, said hollow control means including pressure means for moving said hollow control means relative to the wall of the hole, said hollow control means being located rearwardly of said drill bit a distance sufficient to cause said drill stem to bend upon operation of said pressure means to move said hollow control means relative to said wall of said hole;

means for directing a laser beam longitudinally through said drill stem and into and through said hollow control means;

optical detecting means, positioned within said hollow control means, for detecting the relative position of said laser beam with respect to the bend of said drill stem and for generating signals representative thereof within said hollow control means; and means, positioned within said hollow control means, for receiving and processing said signals and for operating said pressure means in response thereto to move said hollow control means relative to the wall of the hole and thereby to bend said drill stem while said drill bit remains in a locked position in the rock, thereby controlling the direction of drilling by said drill stem.

3. An apparatus as claimed in claim 2, wherein said drill rig includes a feed support for supporting and feeding said drill stem, and, said laser beam directing means comprises a laser generator mounted stably and independently of said drill rig.

4. An apparatus as claimed in claim 3, wherein said drill stem further includes a drilling hammer operated by air supplied through said hollow drilling stem, and said pressure means comprise means operated by said air under the control of said operating means.

5. An apparatus as claimed in claim 3, wherein said pressure means receives energy for operation from rotation of said drill stem in relation to the drill hole.

6. An apparatus as claimed in claim 3, wherein said hollow control means comprises a guide tube joined to and rotatable with said drill stem, and a guide sleeve surrounding said guide tube, said guide tube being rotatable with respect to said guide sleeve due to friction between said guide sleeve and the wall of the hole.

7. An apparatus as claimed in claim 6, wherein said optical detecting means is mounted within and rotatable with said guide tube, said pressure means comprises a plurality of actuators spaced circumferentially between said guide tube and said guide sleeve, and said operating means comprises a control unit within said guide sleeve for receiving said signals from said optical detecting means and angle sensor means for detecting the relative angular position of said guide tube with respect to said guide sleeve and for sending signals representative thereof to said control unit, whereby said control unit operates selected of said circumferentially spaced actuators in response to said signals received from said optical detecting means and from said angle sensor.

8. An apparatus as claimed in claim 7, wherein said optical detecting means comprises a narrow member mounted within said guide tube and extending diametrically across the interior thereof, and plural sensors mounted on said member at positions to detect said laser beam upon rotation of said member with said guide tube independent of the relative position of said laser beam within the cross section of said guide tube.

9. An apparatus as claimed in claim 7, further comprising means for detecting the relative radial position of said guide tube with respect to said guide sleeve and for sending signals representative thereof to said control unit.

* * * * *